US009380924B2

(12) United States Patent
Dirnberger et al.

(10) Patent No.: US 9,380,924 B2
(45) Date of Patent: Jul. 5, 2016

(54) DISH WASHER

(71) Applicant: emz-Hanauer GmbH & Co. KGaA, Nabburg (DE)

(72) Inventors: Albert Dirnberger, Neunburg vorm Wald (DE); Georg Spiessl, Altendorf (DE); Peter Nitsche, Beilngries (DE); Markus Lang, Neunburg vorm Wald (DE)

(73) Assignee: emz-Hanauer GmbH & Co. KGaA (DE)

( * ) Notice: Subject to any disclaimer, the term of this patent is extended or adjusted under 35 U.S.C. 154(b) by 444 days.

(21) Appl. No.: 13/964,317

(22) Filed: Aug. 12, 2013

(65) Prior Publication Data

US 2014/0077671 A1 Mar. 20, 2014

(30) Foreign Application Priority Data

Aug. 17, 2012 (DE) ..... 10 2012 016 541

(51) Int. Cl.
*A47L 15/42* (2006.01)
*D06F 37/42* (2006.01)

(52) U.S. Cl.
CPC ..... *A47L 15/4259* (2013.01); *A47L 15/4246* (2013.01); *A47L 15/4263* (2013.01); *D06F 37/42* (2013.01)

(58) Field of Classification Search
CPC ... D06F 39/14; A47L 15/4259; E05C 19/026; E05C 19/063; E05C 19/06; E05C 19/02
See application file for complete search history.

(56) References Cited

U.S. PATENT DOCUMENTS 2,244,344 A 6/1941 North et al.
2,376,325 A * 5/1945 Borchers ..... E05C 19/026 292/18
2,594,582 A 4/1952 Quinn
6,954,992 B2 10/2005 Hwang
7,299,809 B2 11/2007 Kang

FOREIGN PATENT DOCUMENTS

KR 10457580 B1 6/2004
KR 10457586 B1 6/2004

OTHER PUBLICATIONS

Korean counterpart application No. KR10-2013-0096818, office action issued Dec. 10, 2014, English translation.
Korean office action in copending Korean patent application No. 10-2013-0096818 dated Jul. 30, 2015, English translation.
Office Action in co-pending Chinese Appl. No. 201310356336.7 dated Jul. 1, 2015.

* cited by examiner

*Primary Examiner* — David Cormier
(74) *Attorney, Agent, or Firm* — Robert R. Deleault, Esq.; Mesmer & Deleault, PLLC

(57) ABSTRACT

A dish washer comprises a carcass having a washing compartment accessible through an access opening, and a door attached to the carcass for closing the access opening. The door is bounded on its door side facing the washing compartment by a door inner wall, which provides sealing contact surfaces for a sealing arrangement attached to the carcass. A door latch comprises a latch head attached to the door and fixed relative to the latter, and a latch unit arranged on the carcass and having two latch arms which are movable relative to one another and embrace the latch head on both sides when the door is closed. On closing the door the latch head runs against the latch arms and pushes apart the latter from a relative rest position against spring force. The latch head rises preferably completely above the surface contour of the door inner wall.

22 Claims, 5 Drawing Sheets

DISH WASHER

Figure 1:
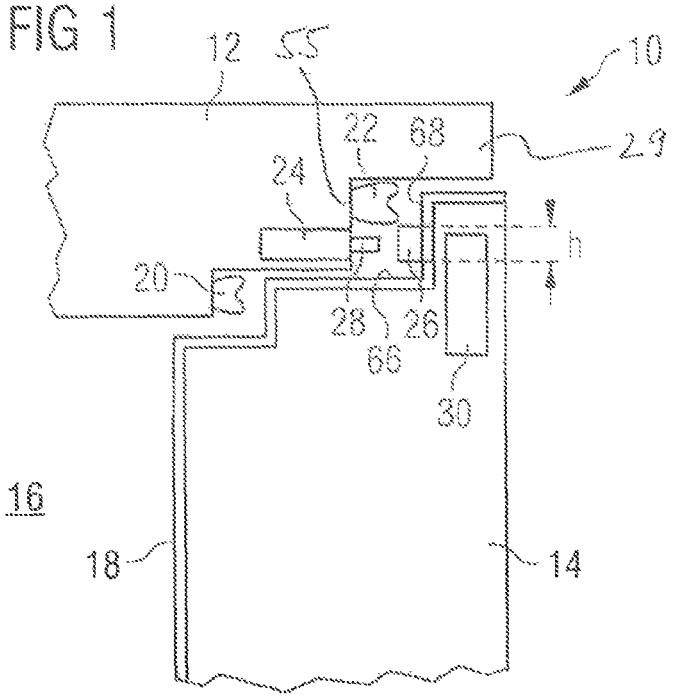

The invention relates generally to a dish washer and especially to a door latch, with which a door of such a dish washer can be kept closed with respect to a carcass of the dish washer containing a washing compartment.

For such a dish washer a solution has proved advantageous in which there is attached to the door a latch head which on closing the door is embraced on both sides by two movable latch arms arranged on the carcass. A suitable spring arrangement is used to apply to the latch arms a prestressing force by which the arms are prestressed in the direction towards one another. In order to close the door, the spring force must be overcome in order to push apart the latch arms so that the latch head can slide between the latch arms and be embraced by the two latch arms.

With regard to the prior art concerning door latches having a latch head which is embraced on both sides by two latch arms when the door is closed, reference is made, for example, to U.S. Pat. No. 2,594,582.

In the case of dish washers, in particular those intended for domestic use, the space available in the door for accommodating components is generally limited. Because the latch head typically takes up considerably less space than a latch unit of the door latch equipped with the two latch arms, it is sensible to arrange the latch head on the door and the latch arms on the carcass of the dish washer. This applies particularly when—as is often the case in modern dish washers—an electronic assembly with control function for operating the dish washer is accommodated in the door in the upper region of the door (at the top with respect to the installation situation of the dish washer). Such an electronic assembly takes up a certain amount of constructional space itself, which reduces the constructional space available for other components, in particular latch components, in this region of the door.

An object of the invention is to provide a dish washer in which there are as few space limitations as possible in the door for accommodating other components, such as for example an electronic assembly.

In achieving this object, the invention starts from a dish washer, comprising

- a carcass having a washing compartment accessible through an access opening,
- a door attached to the carcass for closing the access opening, the door being bounded on its door side facing the washing compartment by a door inner wall which provides sealing contact surfaces for a sealing arrangement attached to the carcass, and
- a door latch having a latch head attached to the door and fixed relative to the latter, and a latch unit arranged on the carcass and having two latch arms which are movable relative to one another and embrace the latch head on both sides when the door is closed, the latch head on closing the door running against the latch arms and pushing apart the latter from a relative rest position against spring force.

According to the invention, the latch head rises above the surface contour of the door inner wall.

In a preferred configuration, the latch head is arranged in a manner completely raised with respect to the surface contour of the door inner wall. The latch head is accordingly not situated in a recess or a space otherwise set back with respect to the surface contour of the door inner wall. Instead, it preferably protrudes completely with respect to the surface contour of the door inner wall, completely relating to that part of the latch head which is intended for cooperating with the latch arms. In such a configuration of the dish washer, no constructional space in the interior of the door required for accommodating, for example, an electronic assembly is taken up by the latch head.

In a preferred embodiment, the latch arms project with free arm ends from the carcass, which arm ends on closing the door run onto the latch head and in doing so are pushed apart.

In a preferred embodiment, the latch unit includes a latch housing in which the latch arms are supported and a spring arrangement generating the spring force is received, the latch arms having free arm ends which on closing the door run onto the latch head and in doing so are pushed apart, and the free arm ends of the latch arms protruding from the latch housing.

In a preferred embodiment, the carcass includes a front wall, above which overhangs a carcass top and behind which the latch unit is accommodated, the latch arms protruding through a cutout in the front wall beyond the latter.

In a preferred embodiment, the sealing arrangement comprises a seal closer to the washing compartment and a seal farther from the washing compartment, the latch unit being arranged between the seal closer to the washing compartment and the seal farther from the washing compartment.

In a preferred embodiment, the door inner wall includes two front-wall surfaces separated by a step, the latch head being seated in front of the one of the two front-wall surfaces farther from the washing compartment and not reaching further, and preferably reaching even a shorter distance, than up to the one of the two front-wall surfaces closer to the washing compartment.

As far as the configuration of the latch head is concerned, the latter has a cross-sectional width which is effective for pushing apart the latch arms and, when viewed in the closing direction of the door, increases from a point of impact at which the latch arms run against the latch head on closing the door up to a point of greatest width. After this point of greatest width, the effective cross-sectional width of the latch head expediently contracts again. Preferably, at least the part of the latch head which reaches from the point of impact up to the point of greatest cross-sectional width—when viewed in the closing direction of the door—rises above the surface contour of the door inner wall.

In one embodiment, the latch head has a substantially constant cross-sectional shape over a height which is greater, for example at least 1.5 times greater, if desired even at least 2 times greater, than the height of the arm sections of the latch arms serving for embracing the latch head. As a result, even with manufacturing or/and mounting tolerances, it is ensured that the latch arms on closing the door can still reliably catch the latch head.

According to another embodiment, the latch arms can have movement play transversely to an arm plane defined by the two arms, and the latch head can carry at least one deflecting collar at the end, in order to deflect the latch arms transversely to their arm plane in the direction towards a central section of the latch head. In this way, too, despite manufacturing or/and mounting tolerances, a reliable grasping of the latch head by the latch arms can be ensured, utilising in this variant the transverse movement play of the latch arms (transverse with respect to the arm plane defined by the arms, i.e. typically vertically in the installation situation of the dish washer).

Preferably, the latch head, over its entire height usable for pushing apart the latch arms (over this usable height it preferably has a substantially constant cross-section), rises above the surface contour of the door inner wall when viewed in the height direction of the latch head.

The latch head can be part of a materially uniformly produced latch head unit which is inserted with a mounting section through a mounting hole formed in the door inner wall. For example, the mounting section, which in the mounted state of the latch head unit is situated beneath the door inner wall, is fixed, for example by screwing, to the door inner wall or a frame part firmly connected thereto. The latch head unit can be, for example, a plastic part produced by injection moulding.

In a preferred configuration, an electronic assembly is accommodated in the door, behind the latch head when viewed in the closing direction. This electronic assembly can, for example, perform control functions for the operating control of the dish washer.

The latch unit of the door latch can have at least one helical tension spring for generating at least part of the spring force, the helical tension spring having, in the region of at least one of its spring ends, a spring section wound with a smaller diameter, which is adjoined in the direction towards the spring end concerned by a spring section wound with a greater diameter. One of the latch arms for its support can in this case engage on the helical tension spring in the smaller-diameter spring section. It is even conceivable that the helical tension spring is seated between the two latch arms and has in the region of each of its ends a smaller-diameter spring section, in which a respective one of the two latch arms engages. The larger-diameter spring section adjoining the smaller-diameter spring section can in this case be utilised, by an axial contact, for carrying away axial supporting forces between the helical tension spring and the latch arm or arms. Of course, other configurations of a spring arrangement generating the prestressing force for the latch arms are possible in the context of the invention.

According to one embodiment, the latch unit has at least one electric switch and a movably arranged actuating slide, separate from the latch arms, for actuating the switch, there being arranged on the door an actuating formation which on closing the door strikes the actuating slide and displaces the latter for a switching operation of the switch. The actuating formation can be designed as an actuating rib which, for example, runs in between the latch arms on closing the door. According to one configuration, the actuating formation can be produced as a unitary component with the latch head, i.e. latch head and actuating formation can be formed jointly on a single component. Alternatively, it is of course possible for the actuating formation to be arranged at another place on the door—remote from the latch head.

In order to prevent, when the door is open, an actuation of the switch by an object inserted from outside, for example a test finger or a screwdriver, in a preferred embodiment it is provided that the latch unit has a lead-in member, separate from the actuating slide and the latch arms, with a lead-in funnel for the actuating formation, the lead-in member being arranged relative to the actuating slide in the latch unit in such a way that on closing the door the actuating formation first runs into the lead-in funnel before it strikes the actuating slide. Given a sufficiently narrow configuration of the lead-in member at the narrow end of the lead-in funnel, it is ensured that no foreign body can be inserted through the lead-in funnel in order to actuate the actuating slide.

To compensate for any mounting or/and manufacturing tolerances, the lead-in member can have movement play, in the direction transversely to the door closing direction, relative to the actuating slide and relative to the latch arms. Alternatively or additionally to a switch provided in the latch unit, the latch head can carry a sensor element, cooperating with at least one of the latch arms, for sensing the closed state of the door. The sensor element on the latch head can operate, for example, according to a capacitive, inductive, magnetic or else mechanical detection principle. For example, it is conceivable to provide a permanent magnet on one or both of the latch arms, the magnetic field of which can be detected by a reed contact or Hall sensor arranged on the latch head. By locating the sensing of the closed door state in the door, long cable runs for transmitting the sensor signal to an electronic assembly accommodated in the door can be avoided.

Figure 2:
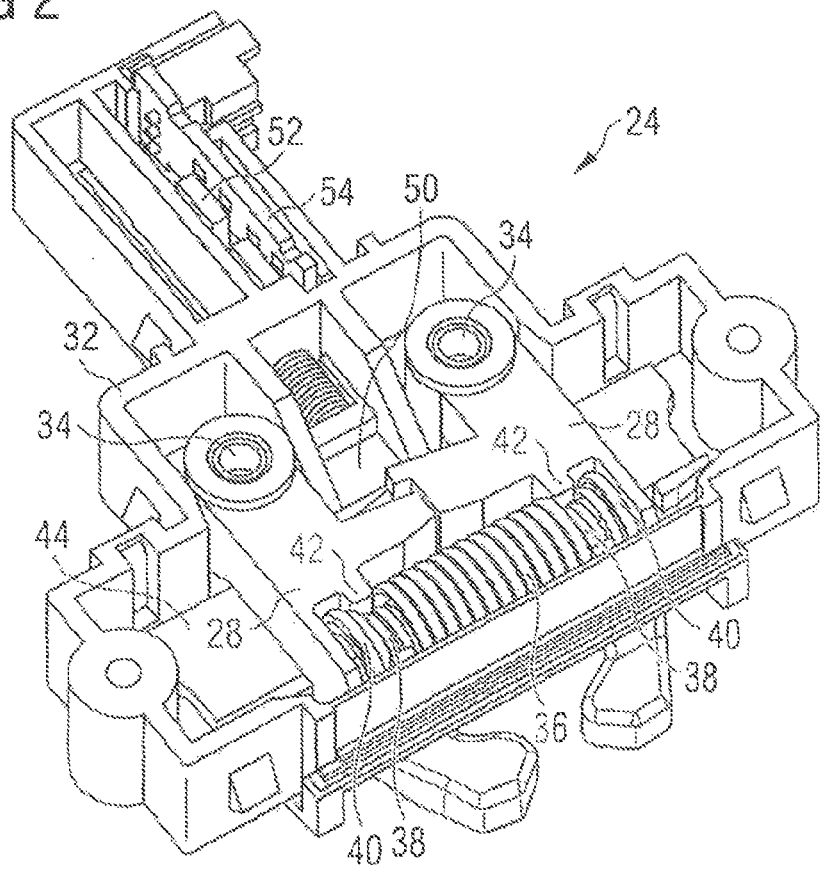
Figure 3:
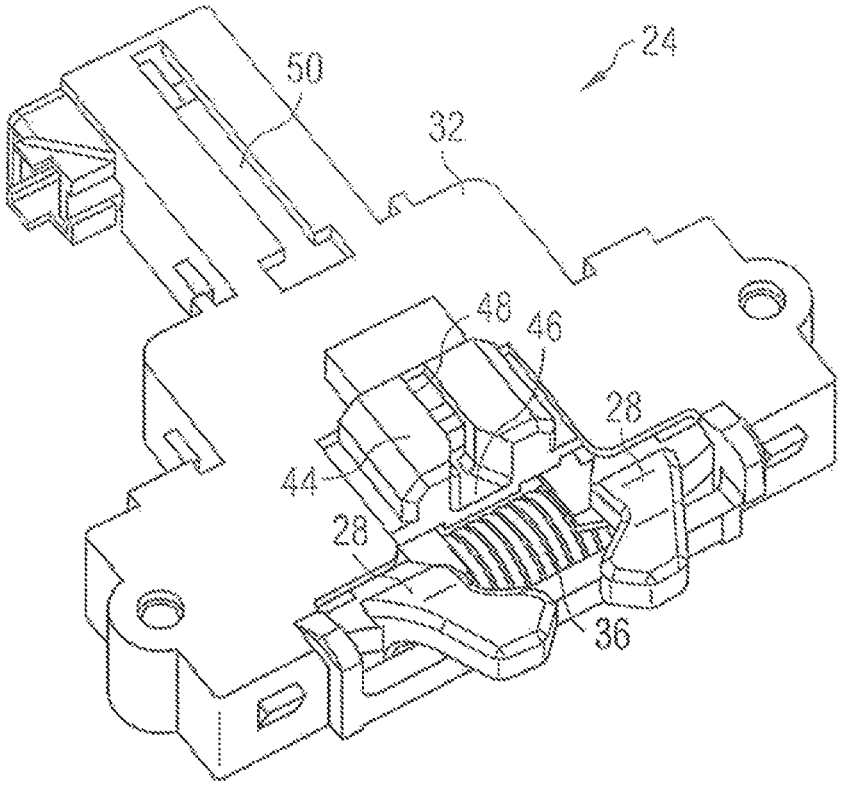
Figure 4:
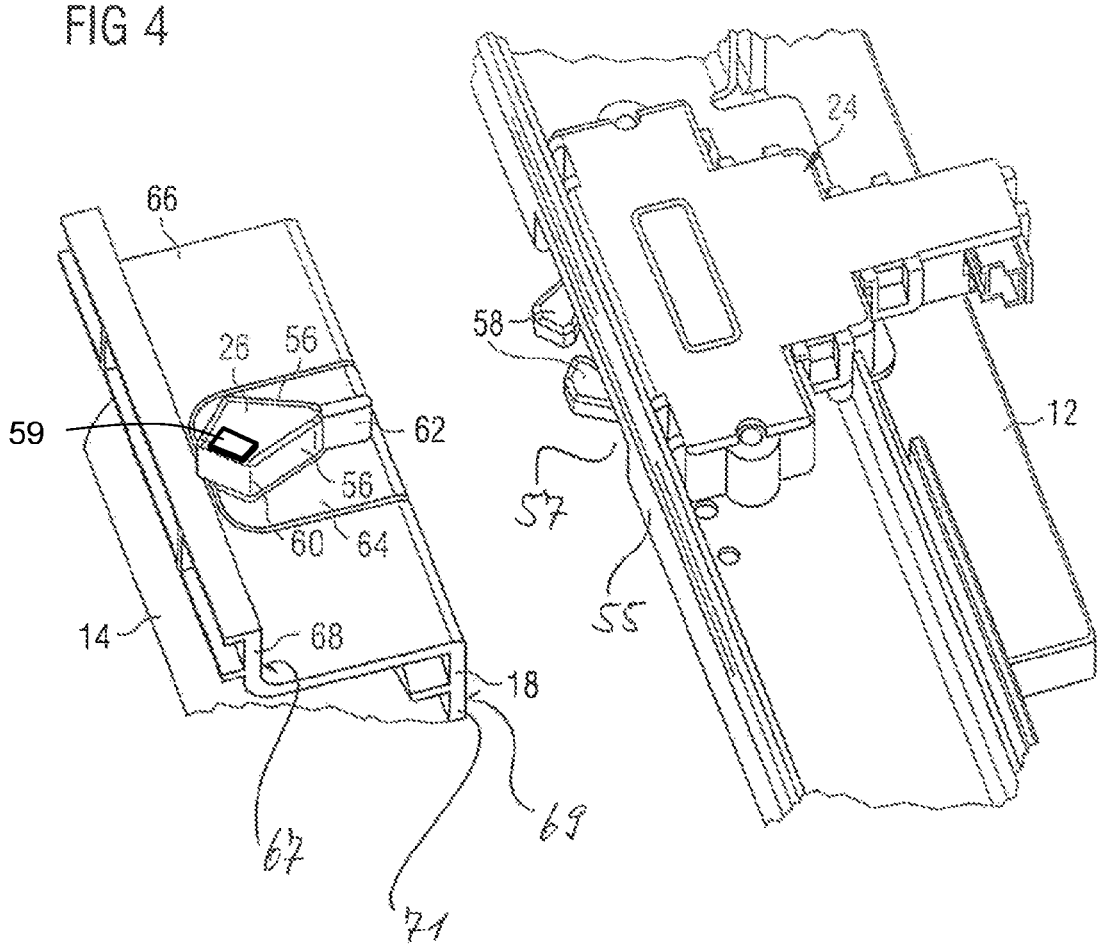
Figure 5:
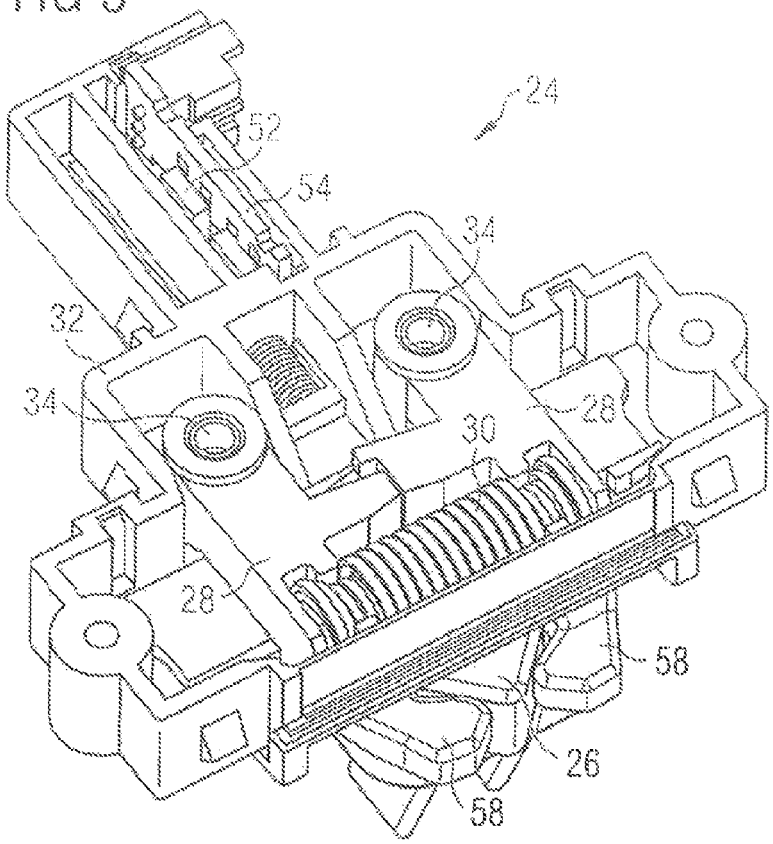
Figure 6:
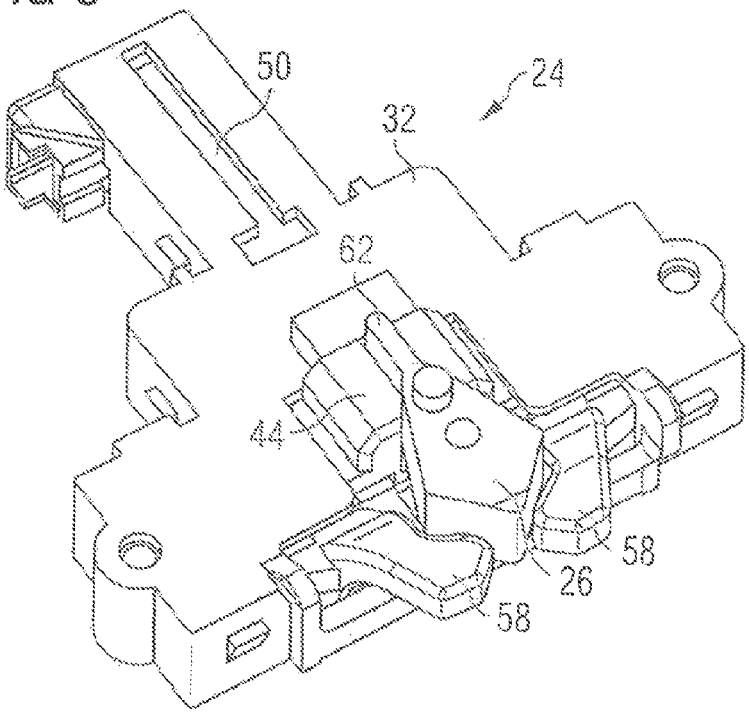
Figure 7:
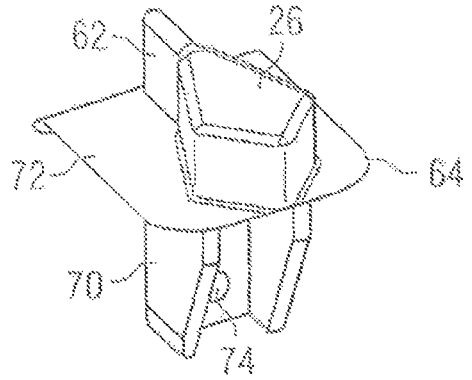
Figure 8:
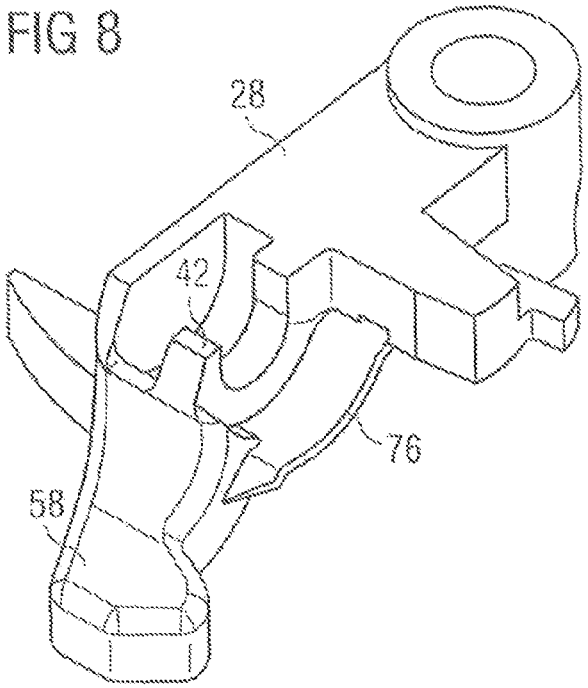
Figure 9:
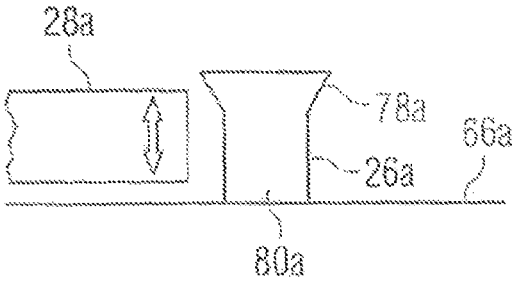

The invention is explained in more detail below with the aid of the appended drawings, in which:

FIG. 1 shows, highly schematically, a detail of a dish washer in the region of a door latch of the same, FIG. 2 shows a perspective view of a latch unit, to be mounted in a carcass of the dish washer, of a door latch according to one embodiment, FIG. 3 shows the latch unit of FIG. 2 from a rear viewing angle, FIG. 4 shows a mounting situation for the door latch according to the embodiment of FIGS. 2 and 3, FIG. 5 shows the latch unit of FIG. 2 in a situation in which a latch head is caught between latch arms of the latch unit, FIG. 6 shows the latch unit in the situation according to FIG. 5, but from a rear viewing angle, FIG. 7 shows a latch head unit having the latch head according to FIGS. 5 and 6, FIG. 8 shows, in a perspective view, one of two latch arms of the latch unit according to FIGS. 2 and 3, and FIG. 9 shows, schematically, a variant configuration for the latch head.

Reference is made first of all to the schematic representation according to FIG. 1. There, for a dish washer generally designated by 10, a carcass 12 and a door 14 are indicated in a detail. In the carcass 12 there is provided, in a manner known per se, a washing compartment 16, in which the dishes to be cleaned are placed. The washing compartment 16 is accessible through an access opening (not designated specifically) which is closable by the door 14. In customary models of domestic dish washers, the door 14 is pivotably attached to the carcass 12, typically about a horizontal pivot axis close to the floor. The door 14 has, on its door inner side facing the washing compartment 16, a door inner wall 18, frequently composed of a sheet-metal material, occasionally of a plastic material, which may also be referred to as door inner-side lining and which closes off the wet area when the door is closed. The door inner wall 18 provides sealing contact surfaces (not designated specifically) for being contacted by a sealing arrangement attached to the carcass 12, which is formed by two bulbous seals 20, 22 in the example shown. The bulbous seal 20 closer to the washing compartment ensures here a sealing-off of the wet area towards the outside, while the bulbous seal 22 farther from the washing compartment ensures an additional acoustic sealing-off. On closing the door 14, the latter presses with its door inner wall 18 against the two bulbous seals 20, 22 and compresses these seals.

To keep the door 14 closed, use is made of a door latch which comprises a latch unit 24, mounted on the carcass 12 between the seal 20 closer to the washing compartment and the seal 22 farther from the washing compartment, and a latch head 26 mounted on the door 14. Part of the latch unit 24 is a pair (only schematically indicated) of latch arms 28, preferably rigidly designed, i.e. not elastic, which on closing the door come into engagement with the latch head 26 and embrace the latter horizontally on both sides. It can be seen in FIG. 1 that the latch arms 28 project underneath a carcass top 29 from the carcass 12, i.e. are not completely sunk in the carcass. The latch arms 28 do not, however, project beyond the carcass top 29, but are covered by the latter. The projecting part of the latch arms 28 forms free arm ends which on closing the door run onto the latch head 26 and in doing so are pushed apart.

Despite the basically schematic manner of representation, it can be seen in FIG. 1 that the latch head 26 has a vertical height h which is greater (for example about one and a half to two times greater) than the height, measured in the same direction, of the free end sections, intended for embracing the latch head 26, of the latch arms 28. Mounting tolerances of the door 14 in the vertical direction with respect to the carcass 12 thus have no detrimental effect on the functioning of the door latch.

The space in the interior of the door 14 behind the latch head 26 is at least partly utilised by an electronic assembly 30 which comprises components responsible for the control of the machine operation of the dish washer 10 and is typically microprocessor-controlled.

Reference is now made additionally to FIGS. 2 and 3, which show an embodiment of the latch unit 24.

The latch unit 24 has a latch housing 32, preferably produced from plastic, in which the two latch arms 28 are mounted so as to be pivotable about an axis substantially vertical in the final assembly state. In the example shown, the latch arms 28 are for this purpose each fitted on a bearing pin 34 in the region of that one of their ends inside the housing. Instead of a pivotable mounting, it is also conceivable for the latch arms alternatively to have a bearing or guidance which enables a linear displacement of the latch arms. In the region of their opposite, free ends, the latch arms 28 are intended for cooperating with the latch head 26; these ends of the latch arms 28 project at least partly from the latch housing 32 in the example shown.

In the latch housing 32, there is received a spring arrangement which prestresses the latch arms 28 in the direction towards one another. In the example shown, this spring arrangement is formed by a helical tension spring 36 which is seated between the latch arms 28 and prestresses the free ends of the two latch arms 28 in the direction towards one another. To push apart the two latch arms 28, the restoring force of the helical tension spring 36 has to be overcome.

It can be seen in FIG. 2 that the helical tension spring 36 has, in the region of each of its two axial spring ends, a reduced-diameter spring section 38 which is adjoined by a larger-diameter spring section 40 in the direction towards the respective spring end. The two latch arms 28 each have a part-ring-shaped engaging formation 42, by which they engage in the respective reduced-diameter spring section 38. Adjoining each of the reduced-diameter spring sections 38, towards the spring centre, the winding diameter of the helical tension spring 36 increases again. By the engagement of the engaging formations 42 in the reduced-diameter spring sections 38, an axial support of the helical tension spring 36 on the latch arms 28 is realised.

The latch unit 24 furthermore includes a lead-in member 44, separate from the latch arms 28, which has movement play in the horizontal plane transversely to the closing direction of the door, i.e. in the same plane in which the latch arms 28 are movable relative to one another. This lead-in member 44 forms, as can be seen especially in FIG. 3, a lead-in funnel 46 for an actuating formation, still to be described further below, which is arranged on the door of the dish washer and on closing the door penetrates into the lead-in funnel 46 and is led by the latter into a guiding slot 48, the width of which is dimensioned so small that essentially only the aforementioned actuating formation fits into it.

An actuating slide 50, accommodated linearly movably in the latch housing 32 in the example shown, serves for actuating an electric switch 52 which is mounted in the latch housing 32 on a printed circuit board 54. The switch 52 serves as a door contact switch, by means of which the closing and opening of the door of the dish washer can be communicated to the appliance control contained in the electronic assembly 30 (cf. FIG. 1). Instead of a linearly movable actuating slide, it is of course also possible to use a differently movable actuating member for activating the switch 52, for example a pivotable lever or a rotary slide.

Reference is now made additionally to FIG. 4. The latch unit 24 is seated in the carcass 12 behind a front wall 55, which is adjoined above by the carcass top 29 which projects beyond the front wall 55 (cf. the representation in FIG. 1). In the front wall 55 there is formed a cutout 57 (cf. FIG. 4), through which the latch arms 28, to be more precise the free ends of the latch arms 28 designated by 58, project and in doing so protrude a little way beyond the front wall 55.

The latch head 26 forms a pair of run-on surfaces 56 for the free ends 58 of the latch arms 28. The run-on surfaces 56 diverge at an acute angle from one another up to a point of greatest cross-sectional width of the latch head 26. The point of greatest cross-sectional width is designated by 60 in FIG. 4. After it, the cross-sectional width of the latch head 26 diminishes again. In the rest state (with the door open), the clear distance between the free ends 58 of the latch arms 28 is less than the cross-sectional width of the latch head 26 at the point 60. When the door is closed, accordingly the free arm ends 58 run against the latch head 26 in the region of the run-on surfaces 56. On continued closing movement of the door 14, the free ends 58 of the latch arms 28 then run along on the run-on surfaces 56 in the direction towards the point 60 of widest cross-section, the latch arms 28 being pushed apart horizontally to an increasing degree. After they have travelled past the point 60, the free arm ends 58 can come closer to one another again under the restoring action of the helical tension spring 36 and in doing so catch the latch head 26 between them. To compensate for any mounting or/and manufacturing tolerances, the lead-in member 44 (shown in FIG. 3) can have movement play, in the direction transversely to the door closing direction, relative to the actuatins slide 50 and relative to the latch arms 28. Alternatively or additionally to a switch provided in the latch unit, the latch head 26 can carry a sensor element 59, cooperating with at least one of the latch arms 28, for sensing the closed state of the door.

While in the example shown in FIG. 4 the run-on surfaces 56 run rectilinearly, it is understood that, for example, a mushroom-head-like, rounded configuration of the peripheral contour of the latch head 26 is equally possible.

At the tip, facing the latch unit 24, of the latch head 26 an actuating rib 62 protrudes from the latter and forms the aforementioned actuating formation for actuating the actuating slide 50 in the latch unit 24. The actuating rib 62 strikes the actuating slide 50 only after reaching the bottom of the lead-in funnel 46 of the lead-in member 44 and from there travelling into the guiding slot 48. The actuating slide 50 is in this way protected from unintended or unauthorised actuation by an object inserted from outside. The transverse movement play of the lead-in member 44 helps to compensate for mounting or/and manufacturing tolerances.

In the example shown in FIG. 4, the latch head 26 is mounted—as part of a latch head unit (cf. FIG. 7) designated generally by 64—on a wall piece 66 of the door inner wall 18, which wall piece extends substantially perpendicularly to the door plane and when the door is upright, i.e. when it is closed, faces substantially vertically upwards. Alternatively, the latch head 26 can be mounted on a wall piece 68 of the door inner wall 18, which wall piece run substantially parallel to the door plane and adjoins the wall piece 66 at right angles in the direction towards the upper door edge. This mounting variant is indicated in FIG. 1. Irrespective of whether the latch head 26 is mounted on the wall piece 66 or the wall piece 68, it protrudes preferably completely with respect to the surface contour of both wall pieces 66, 68, i.e. is not sunk (not even partly sunk) with respect to the surface contour of these two wall pieces 66, 68. This saves available constructional space in the interior of the door, because it is not necessary to provide any recess for the sunk accommodation of the latch head 26.

The wall piece 68 forms on its outer side, i.e. on its side facing the washing compartment, a first front-wall surface 67, closer to the door edge, of the door inner wall 18 (cf. FIG. 4). A second front-wall surface 69, farther from the door edge, of the door inner wall 18 is formed by a wall piece 71 which adjoins the wall piece 66 substantially at right angles and opposite to the wall piece 68. The two front-wall surfaces 67, 69 are consequently separated from one another in a step-like manner by the wall piece 66. As can be clearly seen in the representation of FIG. 4, the latch head 26 is seated in front of the front-wall surface 67 farther from the washing compartment and does not reach further than up to the front-wall surface 69 closer to the washing compartment. The latch head 26 thus does not project beyond the front-wall surface 69 closer to the washing compartment.

FIGS. 5 and 6 show the relative arrangement of latch unit 24 and latch head 26 when the door is closed and the latch head 26 is accordingly embraced by the latch arms 28. It can be seen that the actuating rib 62 has penetrated into the guiding slot 48 of the lead-in member 44.

FIG. 7 shows the latch head unit 64 already mentioned. For mounting the latch head unit 64, there is provided at the relevant place of the door inner wall 18 a mounting hole (not illustrated specifically in the figures), into which the latch head unit 64 is inserted, with a mounting section 70 in front, to such an extent until it bears on the door inner wall 18 with a bearing flange 72 around the hole edge of the mounting hole. The mounting section 72 in the example shown has a fastening hole 74 for introducing a fastening screw (not illustrated specifically), by which the latch head unit 64 can be fixed to the door 14.

Finally, reference is further made to FIG. 8, in which one of the two latch arms 28 (configured symmetrically to one another) is shown. There can be seen the part-ring-shaped (here semicircular) engaging formation 42 and a partly protruding strengthening body 76, composed for example of metal, which is embedded in the material of the latch arm 28 and serves for stiffening the same.

In the embodiments described thus far, the latch arms 28, i.e. at least the free arm ends 58 intended for embracing the latch head 26, can have a movement play transversely to an arm plane defined by the two latch arms. The arm plane corresponds here to a plane orthogonal to the pivot axes of the latch arms 28 (these pivot axes are determined by the bearing journals 34). Because of the greater height h of the latch head 26 in comparison with the height (thickness) of the free arm ends 58, such a transverse movement play of the latch arms 28 in the embodiments described thus far is, however, not absolutely necessary to compensate for mounting or/and manufacturing tolerances.

FIG. 9 shows a variant in which the tolerance compensation is based at least partly on a transverse movement play of the latch arms. Like or functionally similar components are provided in this figure with the same reference symbols as previously, but supplemented by a small letter. The variant of FIG. 9 provides at least one deflecting collar 78*a* at the end, which collar is formed on the latch head 26*a* and has an obliquely shaped collar underside. The deflecting collar 78*a* bounds at one end a central section 80*a* of the latch head 26*a*, this central section 80*a* being designed to be caught between the latch arms 28*a* on closing the door. If on closing the door the latch arms 28*a*, owing to tolerances that exist, run against the deflecting collar 78*a* and there in particular against the oblique collar underside, they are deflected by the collar 78*a* in the direction towards the central section 80*a*, this being possible because of the transverse movement play of the latch arms 28*a*. It is understood that the central section 80*a* can be bounded at both ends by a respective deflecting collar 78*a* or comparable deflecting formation. The length of the central section 80*a* in the variant of FIG. 9 does not necessarily have to be greater than the thickness of the free ends 58 of the latch arms 28—it is possible for both to be approximately of the same size.

The invention claimed is:

1. A dish washer, comprising:

a carcass having a washing compartment accessible through an access opening;

a door attached to the carcass for closing the access opening, the door being bounded on its door side facing the washing compartment by a door inner wall which provides sealing contact surfaces for a sealing arrangement attached to the carcass; and a door latch including a latch head attached to the door in a fixed manner relative to the latter, and a latch unit arranged on the carcass and having two latch arms which are movable relative to one another and embrace the latch head on a pair of run-on surfaces of the latch head when the door is closed, the latch head on closing the door running against the latch arms and pushing apart the latter from a relative rest position against spring force, wherein the latch head rises above a surface contour of the door inner wall, wherein the carcass includes a front wall having a cutout, wherein the latch unit is accommodated behind the front wall in the carcass and the latch arms protrude through the cutout outwardly, and wherein the cutout is open towards a bottom of the carcass.

2. The dish washer according to claim 1, wherein the latch arms project with free arm ends from the carcass, which arm ends on closing the door run onto the latch head and in doing so are pushed apart.

3. The dish washer according to claim 1, wherein the latch unit includes a latch housing supporting the latch arms and accommodating a spring arrangement generating the spring force, the latch arms having free arm ends which on closing the door run onto the latch head and in doing so are pushed apart, and wherein the free arm ends of the latch arms protrude from the latch housing.

4. The dish washer according to claim 1, wherein the carcass includes a front wall, above which overhangs a carcass top and behind which the latch unit is accommodated, wherein the latch arms protrude through a cutout in the front wall beyond the latter.

5. The dish washer according to claim 1, wherein the sealing arrangement comprises a seal closer to the washing compartment and a seal farther from the washing compartment, and wherein the latch unit is arranged between the seal closer to the washing compartment and the seal farther from the washing compartment.

6. The dish washer according to claim 1, wherein the door inner wall includes two front-wall surfaces separated by a step, the latch head being seated in front of the one of the two front-wall surfaces farther from the washing compartment and not reaching further than up to the one of the two front-wall surfaces closer to the washing compartment.

7. The dish washer according to claim 1, wherein the cross-sectional width of the latch head which is effective for pushing apart the latch arms, when viewed in the closing direction of the door, increases from a point of impact at which the latch arms run against the latch head on closing the door up to a point of greatest width and contracting again after this point of greatest width, and wherein at least the part of the latch head which reaches from the point of impact up to the point of greatest cross-sectional width, when viewed in the closing direction of the door, rises above the surface contour of the door inner wall.

8. The dish washer according to claim 1, wherein the latch head has a substantially constant cross-sectional shape over a height (h) which is at least 1.5 times greater than the height of the arm sections of the latch arms serving for embracing the latch head.

9. The dish washer according to claim 1, wherein the latch head, over its entire height usable for pushing apart the latch arms, rises above the surface contour of the door inner wall when viewed in the height direction of the latch head.

10. The dish washer according to claim 1, wherein the latch head is part of a materially uniformly produced latch head unit which is inserted with a mounting section through a mounting hole formed in the door inner wall.

11. The dish washer according to claim 1, wherein the latch head is completely raised with respect to the surface contour of the door inner wall.

12. The dish washer according to claim 1, wherein an electronic assembly is accommodated in the door, behind the latch head when viewed in the closing direction.

13. The dish washer according to claim 1, wherein the latch unit includes a helical tension spring for generating at least part of the spring force, the helical tension spring having, in the region of at least one of its spring ends, a spring section wound with a smaller diameter, one of the latch arms for its support engaging on the helical tension spring in the smaller diameter of the spring section.

14. The dish washer according to claim 13, wherein the helical tension spring is seated between the two latch arms and has in the region of each of its ends a spring section wound with a smaller diameter, in which a respective one of the two latch arms engages.

15. The dish washer according to claim 1, wherein the latch unit has at least one electric switch and a movably arranged actuating slide, separate from the latch arms, for actuating the switch, wherein an actuating formation is arranged on the door, the actuating formation on closing the door striking the actuating slide and displacing the latter for a switching operation of the switch.

16. The dish washer according to claim 15, wherein the actuating formation is produced as a unitary component with the latch head.

17. The dish washer according to claim 15, wherein the actuating formation is designed as an actuating rib and runs in between the latch arms on closing the door.

18. The dish washer according to claim 15, wherein the latch unit has a lead-in member, separate from the actuating slide and the latch arms, with a lead-in funnel for the actuating formation, wherein the lead-in member is arranged relative to the actuating slide in the latch unit in such a way that on closing the door the actuating formation first runs into the lead-in funnel before it strikes the actuating slide.

19. The dish washer according to claim 18, wherein the lead-in member has movement play, in the direction transversely to the door closing direction, relative to the actuating slide and relative to the latch arms.

20. The dish washer according to claim 1, wherein the latch head is provided with a sensor element, cooperating with at least one of the latch arms, for sensing the closed state of the door.

21. The dish washer according to claim 1, wherein the latch arms have movement play transversely to an arm plane defined by the two arms, and wherein the latch head is provided with at least one deflecting collar at the end, in order to deflect the latch arms transversely to their arm plane in the direction towards a central section of the latch head.

22. The dish washer according to claim 1, wherein the latch head has a substantially constant cross-sectional shape over a height (h) which is at least 2 times greater than the height of the arm sections of the latch arms serving for embracing the latch head.

* * * * *